US011193430B2

(12) United States Patent
Arai

(10) Patent No.: US 11,193,430 B2
(45) Date of Patent: Dec. 7, 2021

(54) GENERAL ENGINE THROTTLE APPARATUS

(71) Applicant: HONDA MOTOR CO., LTD., Tokyo (JP)

(72) Inventor: Tetsuya Arai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/262,232

(22) PCT Filed: Sep. 5, 2018

(86) PCT No.: PCT/JP2018/032907
§ 371 (c)(1),
(2) Date: Jan. 22, 2021

(87) PCT Pub. No.: WO2020/049662
PCT Pub. Date: Mar. 12, 2020

(65) Prior Publication Data

US 2021/0285389 A1 Sep. 16, 2021

(51) Int. Cl.
*F02D 11/10* (2006.01)
*F02D 9/10* (2006.01)

(52) U.S. Cl.
CPC ..... *F02D 11/10* (2013.01); *F02D 9/105* (2013.01); *F02D 2011/101* (2013.01)

(58) Field of Classification Search
CPC ..... F02D 11/10; F02D 9/105; F02D 2011/101
See application file for complete search history.

(56) References Cited

U.S. PATENT DOCUMENTS 4,878,470 A * 11/1989 Burkel ..... F02D 11/06 123/401
5,755,302 A * 5/1998 Lutz ..... B60L 50/15 180/65.21

(Continued)

FOREIGN PATENT DOCUMENTS

EP 0723072 7/1996
EP 0992662 4/2000

(Continued)

OTHER PUBLICATIONS

International Search Report and Written Opinion for International Application No. PCT/JP2018/032907 dated Nov. 20, 2018, 7 pages.

*Primary Examiner* — Joseph J Dallo
(74) *Attorney, Agent, or Firm* — Amin, Turocy & Watson, LLP

(57) ABSTRACT

A throttle apparatus includes a throttle body (12), a throttle valve (13), a throttle shaft (14), an electrically driven motor (15), a drive gear (23), a driven gear (24), a middle gear (25), and a sensor block (19). The middle gear (25) is held by the throttle body (12) such that a gear shaft is displaced from an imaginary straight line (V) connecting together a motor shaft and the throttle shaft (14). A gear arrangement projection part (34) that projects outward by a displacement amount of the middle gear (25) and a connector arrangement projection part (35) that projects to a same side as the gear arrangement projection part (34) at a position adjacent to a motor housing part (12*b*) side of the gear arrangement projection part (34) are formed on an outer surface of the throttle body (12). The motor connector (36) is arranged on the connector arrangement projection part (35) such that the motor connector (36) is in parallel with an axis center of the motor shaft and faces another end side of the throttle body (12). The sensor connector (20) is arranged on the sensor block (19) such that (Continued)

the sensor connector (20) is directed toward the axis center from a direction that is orthogonal to the axis center of the motor shaft.

2 Claims, 6 Drawing Sheets

(56) References Cited

U.S. PATENT DOCUMENTS

| | | | | |
|---|---|---|---|---|
| 7,032,569 | B2 * | 4/2006 | Ikeda | F02D 9/02 123/361 |
| 2002/0111247 | A1 * | 8/2002 | Mori | F16H 15/38 476/46 |
| 2005/0090365 | A1 * | 4/2005 | Tamai | B60W 10/08 477/5 |
| 2007/0084657 | A1 * | 4/2007 | Abe | F02D 11/105 180/219 |
| 2009/0205611 | A1 * | 8/2009 | Tsugami | F02D 9/1035 123/399 |
| 2010/0319658 | A1 * | 12/2010 | Uchiyama | G01D 5/2086 123/337 |
| 2011/0290213 | A1 * | 12/2011 | Ishikawa | F02D 9/1065 123/336 |
| 2012/0160212 | A1 * | 6/2012 | Maki | F02M 35/02 123/403 |
| 2015/0337743 | A1 | 11/2015 | Cowan et al. | |
| 2019/0226408 | A1 * | 7/2019 | Hamasaki | F02M 35/162 |

FOREIGN PATENT DOCUMENTS

| | | |
|---|---|---|
| JP | 11-316121 | 11/1999 |
| JP | 2000-110589 | 4/2000 |
| JP | 2004-239266 | 8/2004 |
| JP | 2005-016438 | 1/2005 |
| JP | 2006-097500 | 4/2006 |
| JP | 2009-287476 | 12/2009 |

* cited by examiner

GENERAL ENGINE THROTTLE APPARATUS

TECHNICAL FIELD

The present invention relates to a throttle apparatus of a general engine used in a lawn mower, an agricultural machine, a generator, and the like.

BACKGROUND

As a throttle apparatus of a general engine, such an apparatus is known which drives a throttle valve by an electrically driven motor.

In this type of throttle apparatus, a throttle shaft is rotatably supported by a throttle body having an intake air introduction hole, and a throttle valve is attached to the throttle shaft. The throttle shaft is rotatably supported by the throttle body and is driven by the electrically driven motor via a power transmission mechanism.

Further, in most of these types of throttle apparatuses, a motor housing part that houses the electrically driven motor is integrally formed with the throttle body. A driven gear is attached to the throttle shaft, and a drive gear is attached to a motor shaft of the electrically driven motor. The drive gear and the driven gear are interconnected to be operable in an interlocked manner with each other via a middle gear. The motor shaft and the throttle shaft are arranged substantially parallel with each other, and the middle gear is arranged at a position that overlaps an imaginary straight line connecting the motor shaft and the throttle shaft. Further, the drive gear, the driven gear, and the middle gear are arranged on one end side in an axial direction (direction along an axis center of the throttle shaft) of the throttle body. A sensor block that includes a sensor for detecting a state (for example, a rotation position of the throttle shaft, an intake air temperature, a pressure, or the like) in the vicinity of the throttle valve is attached to another end side in the axial direction of the throttle body. A motor connector for connecting an electric cable (for example, an electric power cable) to the electrically driven motor is provided in the vicinity of the motor housing part on an outer surface of the throttle body. Further, a sensor connector for connecting an electric cable (for example, a signal cable) to a sensor at the inside is provided on an outer surface of the sensor block.

RELATED ART DOCUMENTS

Patent Documents

[Patent Document 1]
Japanese Unexamined Patent Application, First Publication No. 2005-16438
[Patent Document 2]
Japanese Unexamined Patent Application, First Publication No. 2006-97500
[Patent Document 3]
Japanese Unexamined Patent Application, First Publication No. 2009-287476

SUMMARY OF INVENTION

Problems to be Solved by the Invention

In the throttle apparatus of the related art described above, the middle gear is arranged such that the gear shaft overlaps the imaginary straight line connecting together the motor shaft and the throttle shaft. Therefore, the length of a direction connecting together the throttle shaft and the motor shaft of the outer surface shape of the throttle body may be long, and it may be impossible to compactly mount the throttle apparatus on the general engine.

Further, since in the throttle apparatus of the related art described above, the outer surface shape of the throttle body has a shape elongated in one direction (direction connecting together the motor shaft and the throttle shaft), it is difficult to compactly bundle the cables drawn from the connectors in the vicinity of the throttle body when the direction in which the cable is drawn from the motor connector and a direction in which the cable is drawn from the sensor connector need to be substantially orthogonal to each other. That is, in the case of the throttle apparatus of the related art described above, since the position at which the cable is drawn from the motor connector and the position at which the cable is drawn from the sensor connector are close to each other, the position at which both cables are bundled needs to be a position separated from the throttle body. This hinders compact mounting of the throttle apparatus on the general engine.

A problem to be solved is to provide a general engine throttle apparatus that is able to be compactly mounted on a general engine.

Means for Solving the Problem

A general engine throttle apparatus according to an aspect of the present invention is a throttle apparatus of a general engine that includes: a throttle body that has an intake air introduction hole and a motor housing part; a throttle valve that opens and closes the intake air introduction hole; a throttle shaft that holds the throttle valve and that is rotatably supported by the throttle body; an electrically driven motor that is arranged on the motor housing part such that a motor shaft becomes substantially parallel with the throttle shaft and that gives a rotation operation force to the throttle shaft; a drive gear that is provided integrally with the motor shaft; a driven gear that is provided integrally with the throttle shaft; a middle gear that is held on one end of the throttle body such that a gear shaft becomes substantially parallel with the motor shaft and the throttle shaft and that is engaged with the drive gear and the driven gear; and a sensor block that is attached to a position facing an end part of the throttle shaft on another end of the throttle body and that includes a sensor which detects a state in a vicinity of the throttle valve, wherein a motor connector for connecting an electric cable to the electrically driven motor is provided in a vicinity of the motor housing part on an outer surface of the throttle body, and a sensor connector for connecting an electric cable to the sensor is provided on an outer surface of the sensor block, wherein the middle gear is held by the throttle body such that the gear shaft is displaced from an imaginary straight line connecting together the motor shaft and the throttle shaft, a gear arrangement projection part that projects outward by a displacement amount of the middle gear and a connector arrangement projection part that projects to the same side as the gear arrangement projection part at a position adjacent to a motor housing part side of the gear arrangement projection part are formed on an outer surface of the throttle body, the motor connector is arranged on the connector arrangement projection part such that the motor connector is in parallel with an axis center of the motor shaft and faces another end side of the throttle body, and the sensor connector is arranged on the sensor block such that the sensor connector is directed toward the axis center from a direction that is orthogonal to the axis center of the motor shaft.

According to the configuration described above, the middle gear is arranged such that the gear shaft is displaced from the imaginary straight line connecting together the motor shaft and the throttle shaft. Therefore, it is possible to reduce the distance between the motor shaft and the throttle shaft. As a result, it is possible to shorten the length of the direction that connects together the motor shaft and the throttle shaft of the outer surface shape of the throttle body. Further, the gear arrangement projection part and the connector arrangement projection part are formed on the outer surface of the throttle body, and the motor connector is arranged on the connector arrangement projection part. Since the connector arrangement projection part is formed at a position adjacent to the gear arrangement projection part such that the connector arrangement projection part projects to the same side as the gear arrangement projection part, the outer surface shape of the throttle body becomes a massive shape that is not elongated in one direction. Therefore, the space efficiency around the throttle body is improved. Further, in the throttle apparatus of the present aspect, the motor connector that is provided on the connector arrangement projection part is arranged to be parallel with the axis center of the motor shaft and to be directed to another end side (side where the sensor block is positioned) of the throttle body, and the sensor connector that is provided on the sensor block is arranged to be directed from a direction that is orthogonal to the axis center of the motor shaft toward the axis center. Therefore, the electric cable connected to the motor connector and the electric cable connected to the sensor connector can be loosely curved and can be bundled near the throttle body.

A length of the connector arrangement projection part in a direction along the motor shaft may be shorter than a length in an axial direction of the motor housing part of the throttle body, and the connector arrangement projection part may be arranged to be deviated to the one end side of the throttle body.

In this case, since the motor connector provided on the connector arrangement projection part is arranged at a position that is separated from another end of the throttle body, the electric cable connected to the motor connector can be further loosely curved and can be bundled in the vicinity of the throttle body and the electric cable for the sensor.

Advantage of the Invention

In the general engine throttle apparatus according to an aspect of the present invention, since it is possible to shorten the length of the direction that connects together the motor shaft and the throttle shaft of the outer surface shape of the throttle body, and the connector arrangement projection part is formed adjacent to the gear arrangement projection part on the outer surface of the throttle body, the outer surface shape of the throttle body becomes a massive shape that is not elongated in one direction, and it is possible to enhance the space efficiency around the throttle body. Further, in the general engine throttle apparatus according to an aspect of the present invention, since the motor connector is arranged to be parallel with the axis center of the motor shaft and to be directed to another end side (side where the sensor block is positioned) of the throttle body, and the sensor connector is arranged to be directed from a direction that is crossed with the axis center of the motor shaft toward the axis center, the electric cables connected to both connectors can be loosely curved and can be bundled near the throttle body. Accordingly, it is possible to compactly mount the throttle apparatus on the general engine.

DESCRIPTION OF THE EMBODIMENTS

Hereinafter, an embodiment of the present invention will be described with reference to the drawings.

Figure 1:
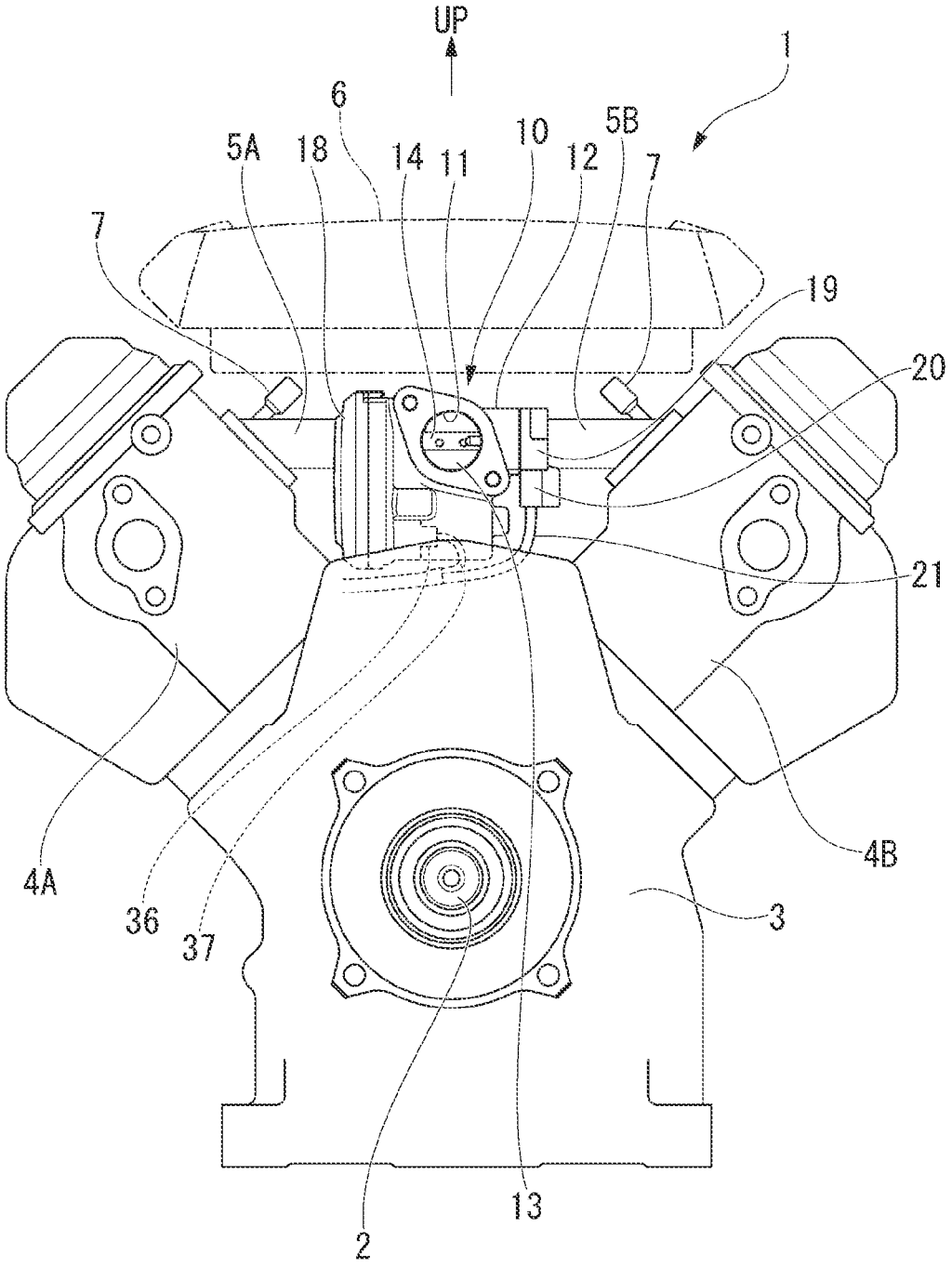
FIG. 1 is a front view of a general engine of an embodiment.

FIG. 1 is a front view of a general engine 1 on which a throttle apparatus 10 of an embodiment of the present invention is mounted.

The general engine 1 of the present embodiment is a V-type dual cylinder engine in which a crankshaft 2 that is an output shaft protrudes substantially horizontally from a crankcase 3. A pair of cylinder blocks 4A and 4B are connected to the crankcase 3 so as to define a substantially V shape. A piston (not shown) that is coupled to the crankshaft 2 in a power transmittable manner is slidably housed in each of the cylinder blocks 4A and 4B. A combustion chamber (not shown) is formed between the piston and a head part of each of the cylinder blocks 4A and 4B. Each of intake pipes 5A and 5B and an exhaust pipe (not shown) are connected to each combustion chamber via an intake valve (not shown) and an exhaust valve (not shown).

The intake pipes 5A and 5B of each cylinder are arranged in a space having a substantially V shape sandwiched between the two cylinder blocks 4A and 4B above the crankcase 3. Each of the intake pipes 5A and 5B is connected to an air cleaner 6 via a common throttle apparatus 10. When the general engine 1 is driven, the flow rate of air suctioned through the air cleaner 6 is adjusted by the throttle apparatus 10. A fuel injection device 7 is arranged on each of the intake pipes 5A, 5B such that the fuel injection device 7 is directed toward a combustion chamber direction of the corresponding cylinder. The air that passes through the throttle apparatus 10 branches at the intake pipes 5A and 5B and is introduced into the combustion chamber of each cylinder together with a fuel injected from the fuel injection device 7.

Figure 2:
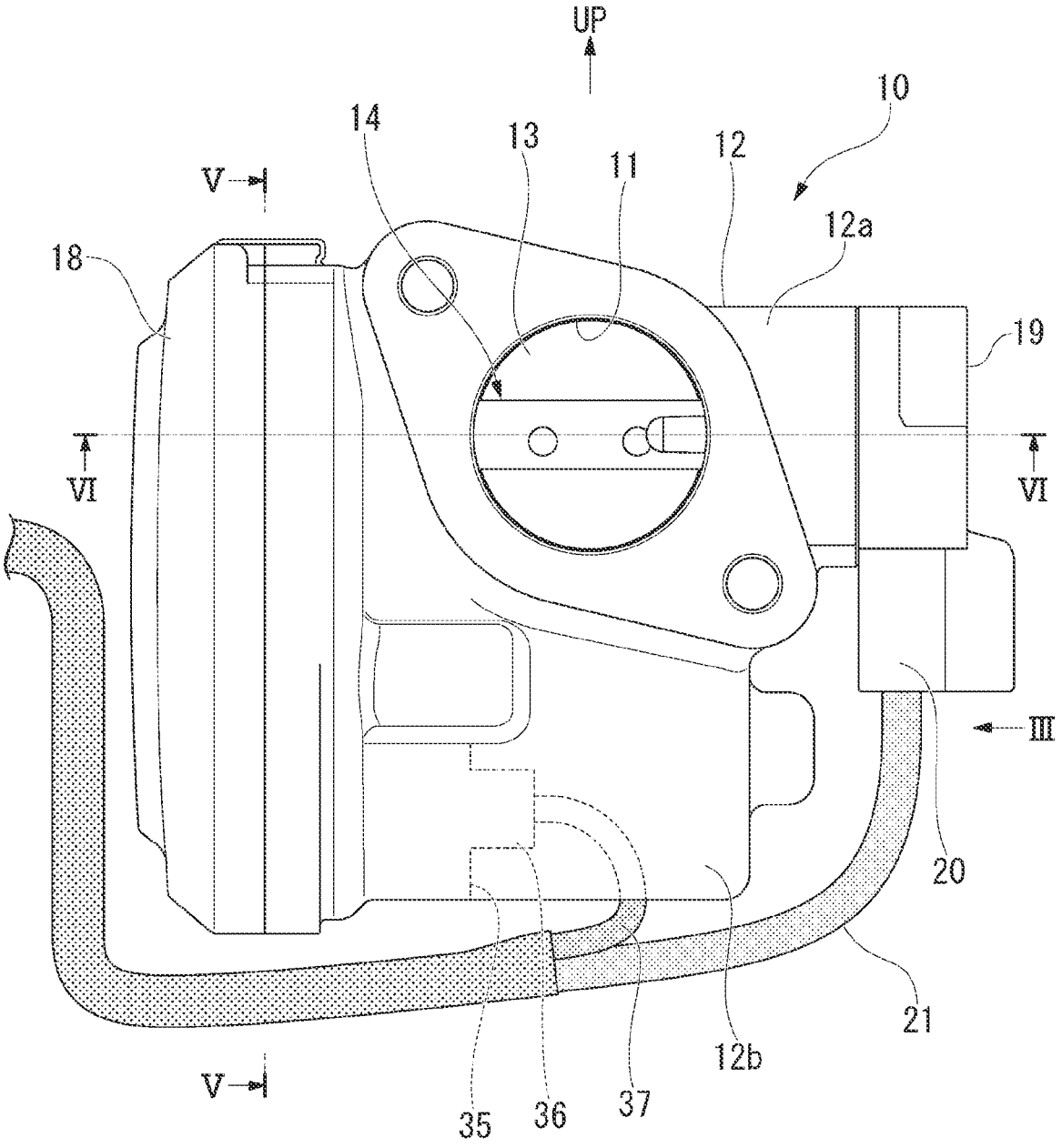
FIG. 2 is a front view of a throttle apparatus of the embodiment.
Figure 3:
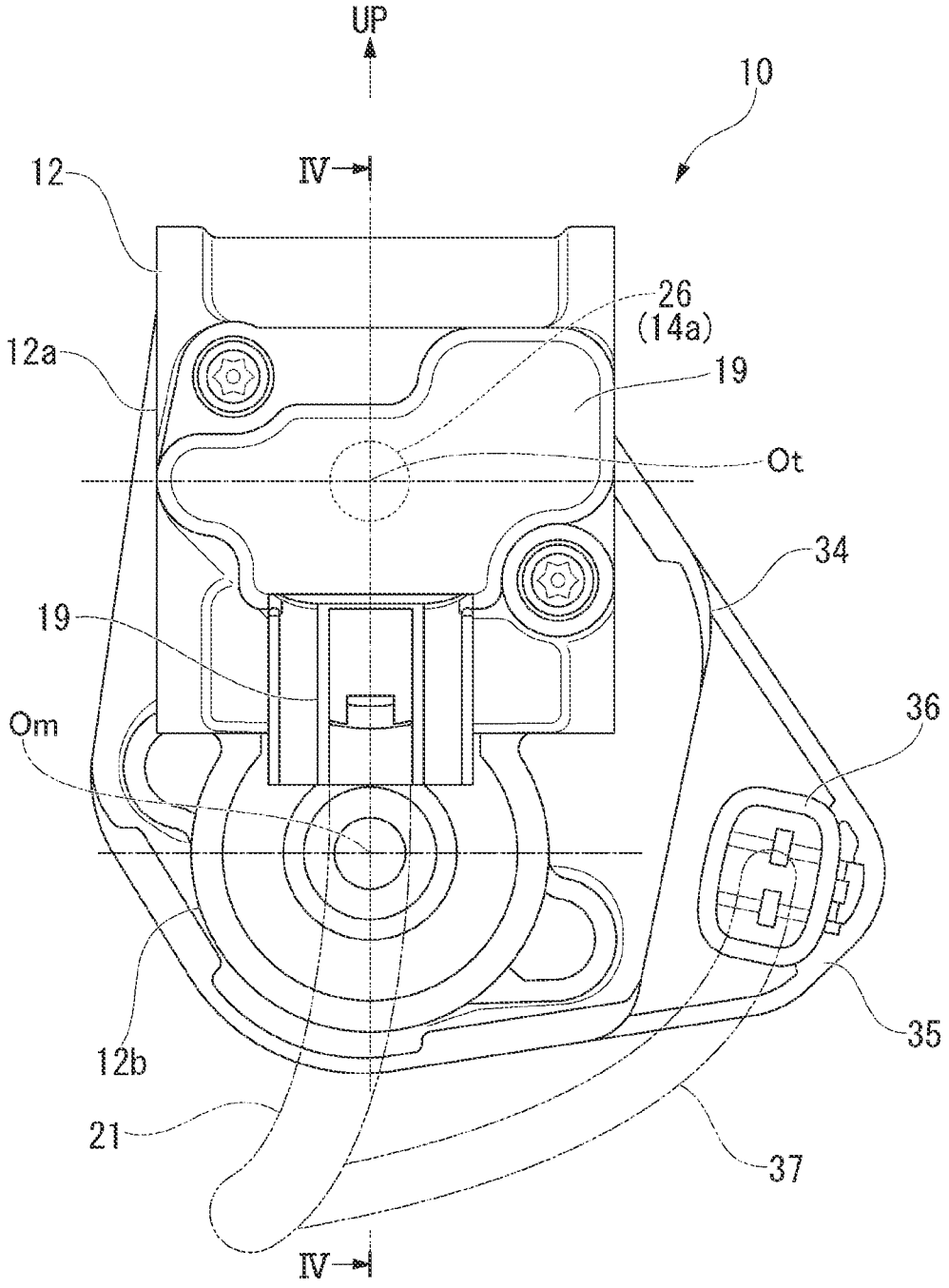
FIG. 3 is a III arrow view of FIG. 2 of the throttle apparatus of the embodiment.
Figure 4:
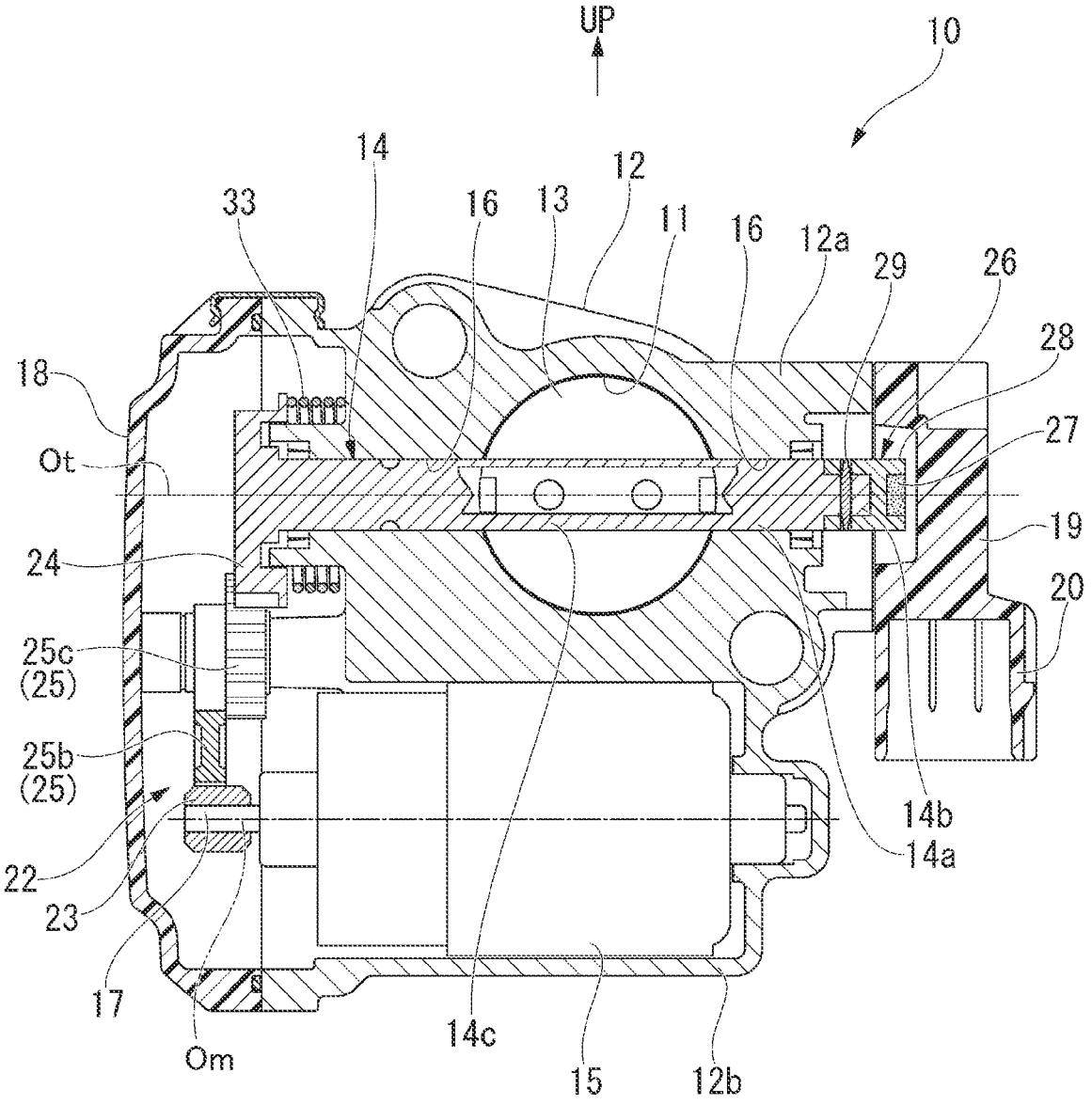
FIG. 4 is a cross-sectional view along a IV-IV line of FIG. 3 of the throttle apparatus of the embodiment.
Figure 5:
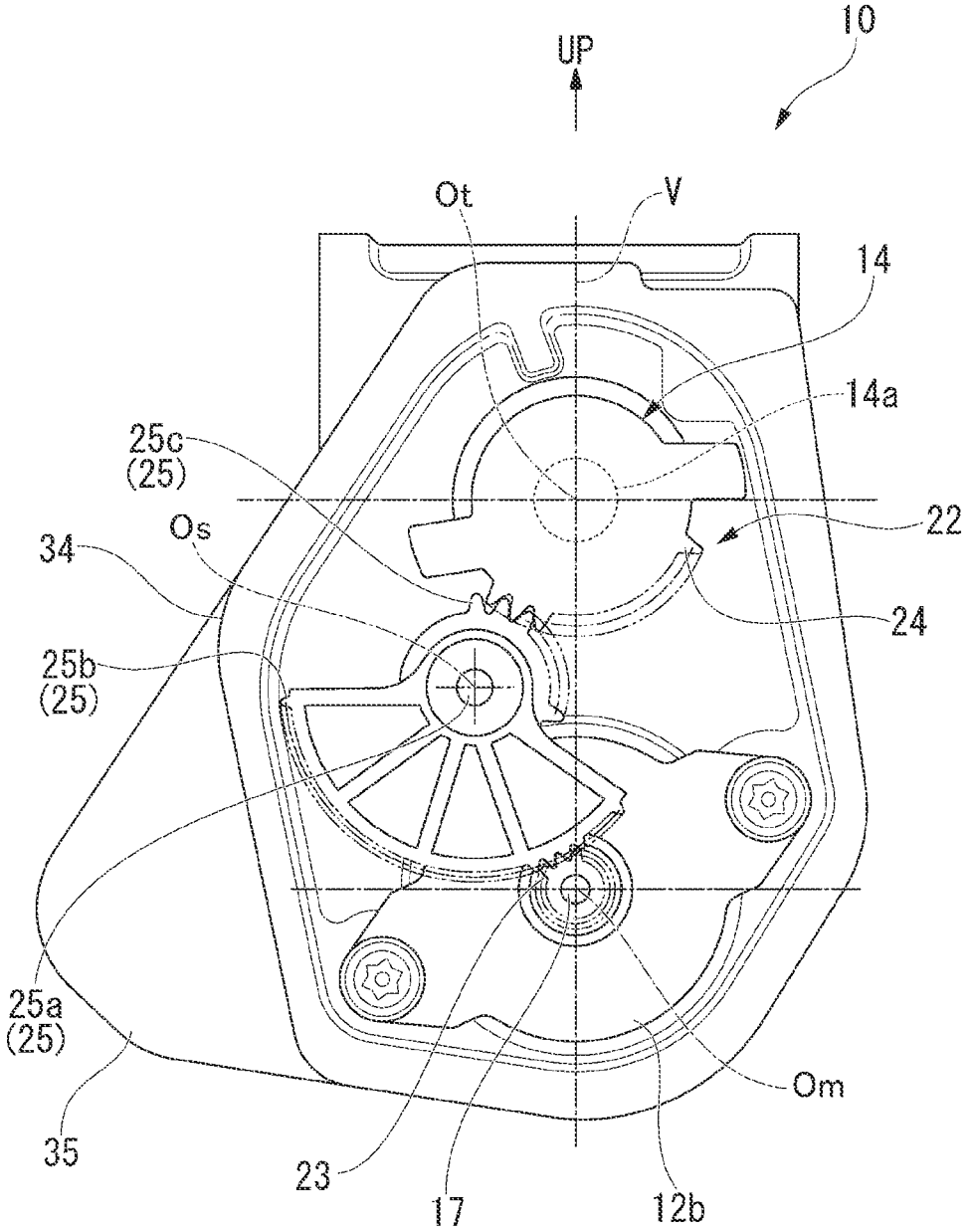
FIG. 5 is an end surface view along a V-V line of FIG. 2 of the throttle apparatus of the embodiment.
Figure 6:
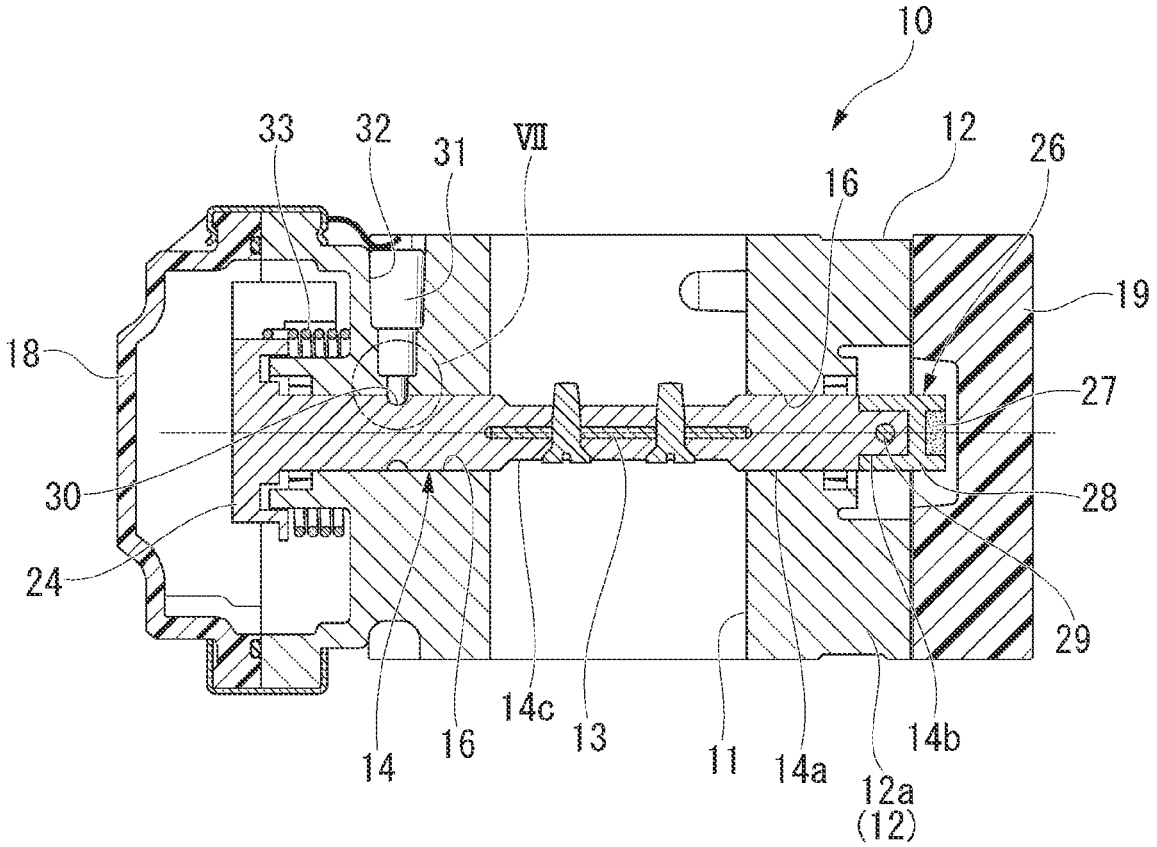
FIG. 6 is a cross-sectional view along a VI-VI line of FIG. 2 of the throttle apparatus of the embodiment.

FIG. 2 is a front view of the throttle apparatus 10, and FIG. 3 is a III arrow view of FIG. 2 of the throttle apparatus 10. FIG. 4 is a cross-sectional view along a IV-IV line of FIG. 3 of the throttle apparatus 10, FIG. 5 is an end surface view along a V-V line of FIG. 2 of the throttle apparatus 10, and FIG. 6 is a cross-sectional view along a VI-VI line of FIG. 2 of the throttle apparatus 10. In the following description of the throttle apparatus 10, for the sake of convenience of explanation, a direction indicated by an arrow UP in the drawing is referred to as "upward", and a direction opposite to the direction indicated by the arrow UP is referred to as "downward".

The throttle apparatus 10 includes: a throttle body 12 that has an intake air introduction hole 11; a throttle valve 13 that opens and closes the intake air introduction hole 11; a throttle shaft 14 that holds the throttle valve 13; and an electrically driven motor 15 that gives a rotation operation force to the throttle shaft 14. An upstream side of the intake air introduction hole 11 of the throttle body 12 is connected to the air cleaner 6, and a downstream side of the intake air introduction hole 11 of the throttle body 12 is connected to the intake pipes 5A and 5B.

In the throttle body 12, a motor housing part 12*b* having a cylindrical shape with a bottom is integrally formed below a body main part 12*a* on which the intake air introduction hole 11 is formed and which has a substantially rectangular shape. A holding hole 16 that extends substantially horizontally to be orthogonal to the intake air introduction hole 11 is formed on the body main part 12*a*. A throttle shaft 14 is rotatably supported by the holding hole 16.

Hereinafter, a direction along an axis center Ot of the throttle shaft 14 supported by the holding hole 16 is referred to as an axial direction of the throttle body 12. The throttle shaft 14 penetrates through the holding hole 16 so as to sandwich the intake air introduction hole 11, and both end parts of the throttle shaft 14 protrudes outward in the axial direction of the throttle body 12.

The throttle valve 13 is formed of a plate material having a circular plate shape. The throttle valve 13 is attached integrally to the throttle shaft 14 in an inside of the intake air introduction hole 11 of the throttle body 12. The throttle shaft 14 is operated and rotated, and thereby, the throttle valve 13 changes an opening area of the intake air introduction hole 11.

The electrically driven motor 15 is housed in the motor housing part 12*b* of the throttle body 12. The electrically driven motor 15 is housed in the motor housing part 12*b* along the axial direction of the throttle body 12. The output shaft 17 of the electrically driven motor 15 extends in parallel with the axis center Ot of the throttle shaft 14 and protrudes to one end side in the axial direction of the throttle body 12. Hereinafter, a surface of outer surfaces of the throttle body 12 on a side at which the output shaft 17 of the electrically driven motor 15 protrudes is referred to as a first lateral surface, and a surface of the outer surfaces of the throttle body 12 on a side opposite to the side at which the output shaft 17 protrudes is referred to as a second lateral surface. A surface of the outer surfaces of the throttle body 12 on a side at which an upstream end part of the intake air introduction hole 11 opens is referred to as a front surface, and a surface of the outer surfaces of the throttle body 12 on a side at which a downstream end part of the intake air introduction hole 11 opens is referred to as a rear surface.

A body cover 18 is attached to the first side of the throttle body 12 so as to cover almost the entire area of the first side. A sensor block 19 is attached to part of the second lateral surface of the throttle body 12 at which another end part of the throttle shaft 14 protrudes. The sensor block 19 includes a variety of sensors for detecting a state (for example, a rotation position of the throttle shaft 14, a temperature or a pressure in the vicinity of the throttle valve 13, or the like) of the throttle shaft 14 and in the vicinity thereof. A sensor connector 20 by which an output signal of the internal sensor is extracted to the outside is provided to protrude on a lower surface of the sensor block 19. As shown in FIG. 2 and FIG. 3, a sensor electric cable 21 (signal cable) is connected to the sensor connector 20. The sensor electric cable 21 is connected to a control device (not shown) for controlling a driving state of the general engine 1.

As shown in FIG. 4 and FIG. 5, the throttle apparatus 10 further includes a power transmission mechanism 22 for transmitting a rotation operation force of the electrically driven motor 15 to the throttle shaft 14. The power transmission mechanism 22 is arranged on the first lateral surface of the throttle body 12 and has an outer side that is covered by the body cover 18. The power transmission mechanism 22 includes: a drive gear 23 that is attached to the output shaft 17 of the electrically driven motor 15; a driven gear 24 that is provided on one end part in an axial direction of the throttle shaft 14; and a middle gear 25 that is arranged between the drive gear 23 and the driven gear 24 and that transmits the rotation operation force from the drive gear 23 to the driven gear 24.

The middle gear 25 includes: a support shaft 25*a* (gear shaft) that is rotatably supported by the throttle body 12; a first middle gear part 25*b* that is engaged to the drive gear 23; and a second middle gear part 25*c* that is engaged to the driven gear 24. The first middle gear part 25*b* and the second middle gear part 25*c* are coaxially fixed to the support shaft 25*a*. The first middle gear part 25*b* is formed to have an outer diameter which is larger than that of the second middle gear part 25*c*. The rotation operation force of the electrically driven motor 15 is transmitted from the drive gear 23 to the driven gear 24 such that the speed is reduced to a predetermined deceleration ratio.

The driven gear 24 is integrally formed on the one end part in the axial direction of the throttle shaft 14. The throttle shaft 14 includes: a shaft main body part 14*a* that is held by the holding hole 16 of the throttle body 12; the driven gear 24 that is integrally formed on one end portion in the axial direction of the shaft main body part 14*a*; and a small diameter part 14*b* that is integrally formed on another end portion in the axial direction of the shaft main body part 14*a*. The shaft main body part 14*a*, the driven gear 24, and the small diameter part 14*b* are integrally formed by casting or the like. The driven gear 24 is arranged on one end side (first lateral surface side) in the axial direction of the throttle body 12 in a state where the shaft main body part 14*a* is inserted in the holding hole 16. The small diameter part 14*b* is arranged on another end side in the axial end of the throttle body 12 in a state where the shaft main body part 14*a* is inserted in the holding hole 16. An outer diameter of the small diameter part 14*b* is formed to be smaller than an outer diameter of the shaft main body part 14*a*.

A detected body block 26 of which a rotation position is detected by the sensor inside the sensor block 19 is attached to the small diameter part 14*b* of the throttle shaft 14. The detected body block 26 includes a magnet 27 which is a detected body and a magnet case 28 that has a substantially cylindrical shape and that holds the magnet 27. The magnet case 28 is fitted to the small diameter part 14*b* and is latched and fixed to the small diameter part 14*b* by a support pin 29 that penetrates through the small diameter part 14*b* in a radial direction. An outer diameter (outer diameter of the detected body block 26) of the magnet case 28 that holds the outside of the magnet 27 is formed to be smaller than an inner diameter of the holding hole 16 of the throttle body 12. More specifically, the outer diameter of the detected body block 26 is formed to be an outer diameter that is almost the same as that of a maximum outer diameter portion of the shaft main body part 14*a*.

Further, as shown in FIG. 4 and FIG. 6, an annular groove 30 is formed on part of an outer circumferential surface of the shaft main body part 14*a* closer to the driven gear 24 than a holding part 14*c* with respect to the throttle valve 13. A release restriction pin 31 (release restriction protrusion) that is slidably engaged with the annular groove 30 of the shaft main body part 14*a* and that restricts the release in the axial direction of the shaft main body part 14*a* is attached to the throttle body 12. The release restriction pin 31 is attached to an attachment hole 32 which is formed from the outer surface of the throttle body 12 to be substantially orthogonal to the holding hole 16. A front end part of the release restriction pin 31 is slidably engaged with the annular groove 30.

Figure 7:
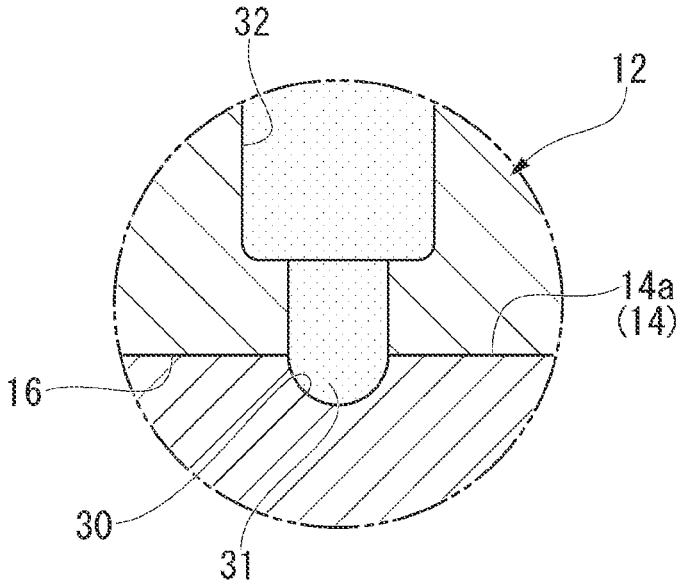
FIG. 7 is an enlarged view of a VII part of FIG. 6 of the throttle apparatus of the embodiment.

FIG. 7 is an enlarged view showing a VII part of FIG. 6.

As also shown in FIG. 7, the annular groove 30 and a front end part (contact part) of the release restriction pin 31 are formed in an arc cross-sectional shape. The front end part of the release restriction pin 31 is formed in, more accurately, a substantially hemispherical shape. The release restriction pin 31 is inserted into the attachment hole 32 when the shaft main body part 14*a* of the throttle shaft 14 is inserted in the holding hole 16 from the first lateral surface side of the throttle body 12. At this time, the front end part of the release restriction pin 31 is engaged with the annular groove 30 of the shaft main body part 14*a*, and thereby, the displacement in the axial direction of the throttle shaft 14 is regulated. Then, the release restriction pin 31 is fixed to the attachment hole 32 by any suitable means such as welding.

The detected body block 26 is assembled in advance to the small diameter part 14*b* on another end of the throttle shaft 14 before the shaft main body part 14*a* of the throttle shaft 14 is inserted in the holding hole 16 as described above. At this time, since the maximum outer diameter of the detected body block 26 is smaller than the minimum inner diameter of the holding hole 16, the detected body block 26 together with the shaft main body part 14*a* can be smoothly inserted in the holding hole 16.

Further, as shown in FIG. 4 and FIG. 6, a torsion coil spring 33 is provided between the throttle body 12 and the driven gear 24. The torsion coil spring 33 is arranged around the axis center Ot of the throttle shaft 14 and biases the throttle shaft 14 around the axis center. A biasing direction by the torsion coil spring 33 is set to a direction in which the throttle valve 13 blocks the intake air introduction hole 11.

Here, as shown in FIG. 5, the support shaft 25*a* (axis center Os of the support shaft 25*a*) of the middle gear 25 is arranged at a position that is displaced by a predetermined amount rearward from an imaginary straight line V that connects together an axis center Om of the output shaft 17 (motor shaft) of the electrically driven motor 15 and an axis center Ot of the throttle shaft 14. Therefore, a substantially middle area in a vertical direction of an outer surface (rear surface) of the throttle body 12 is formed to project in the rear surface direction by an amount of displacement to the rearward side of the middle gear 25 (first middle gear part 25*b*). The part that projects in the rear surface direction is referred to as a gear arrangement projection part 34.

Further, a connector arrangement projection part 35 that projects to the rear surface side continuously to the gear arrangement projection part 34 is formed on the outer surface (rear surface) of the throttle body 12 below the gear arrangement projection part 34. As shown in FIG. 2, the connector arrangement projection part 35 is formed such that the length in the axial direction is shorter length than that of the motor housing part 12*b* of the throttle body 12. The connector arrangement projection part 35 is arranged to be deviated to one end side (first lateral surface side) of the throttle body 12.

A motor connector 36 is provided on another end portion in the axial direction of the connector arrangement projection part 35. The motor connector 36 is provided to protrude on the connector arrangement projection part 35 such that the motor connector 36 is in parallel with the output shaft 17 (motor shaft) of the electrically driven motor 15 and faces another end side in the axial direction of the throttle body 12. An electric cable 37 (refer to FIG. 2 and FIG. 3) for supplying electric power to the electrically driven motor 15 is connected to the motor connector 36. The electric cable 37 for the electrically driven motor 15 is bundled with the sensor electric cable 21 and is drawn in a direction of the control device (not shown) at a position close to the throttle body 12 below the front surface side of the throttle body 12.

As shown in FIG. 3, the sensor connector 20 is provided to protrude on the sensor block 19 such that the sensor connector 20 is directed to the axis center Om (extension part of the axis center Om) from a direction orthogonal to the axis line Om of the output shaft 17 (motor shaft) of the electrically driven motor 15. The electric cable 37 drawn substantially along the output shaft 17 from the motor connector 36 is loosely curved toward a lower position of the sensor connector 20 and is bundled with the sensor electric cable 21 at a position proximate to the throttle body 12 on the lower front surface side close to the second lateral surface of the throttle body 12. At this time, the sensor electric cable 21 is also loosely curved.

As described above, the throttle apparatus 10 of the present embodiment is arranged on the throttle body 12 such that the output shaft 17 of the middle gear 25 is displaced from the imaginary straight line V connecting together the axis center Om of the output shaft 17 of the electrically driven motor 15 and the axis center Ot of the throttle shaft 14. Therefore, it is possible to shorten the length of the direction that connects together the motor shaft 17 and the throttle shaft 14 of the outer surface shape of the throttle body 12.

Further, in the throttle apparatus 10 of the present embodiment, the gear arrangement projection part 34 and the connector arrangement projection part 35 are formed on the outer surface of the throttle body 12 so as to project in this direction, and the motor connector 36 is arranged on the connector arrangement projection part 35. Thereby, the outer surface shape of the throttle body 12 becomes a massive shape that is not elongated in one direction. Accordingly, when the throttle apparatus 10 of the present embodiment is employed, the space efficiency around the throttle body 12 is improved.

Further, in the throttle apparatus 10 of the present embodiment, the motor connector 36 that is provided on the connector arrangement projection part 35 is arranged to be parallel with the axis center Om of the output shaft 17 of the electrically driven motor 15 and to be directed to another end side in the axial direction of the throttle body 12, and the sensor connector 20 that is provided on the sensor block 19 is arranged to be directed from a direction that is orthogonal to the axis center Om of the output shaft 17 of the electrically driven motor 15 toward the axis center Om (extension part of the axis center Om). Therefore, in the throttle apparatus 10 of the present embodiment, the electric cable 37 connected to the motor connector 36 and the electric cable 21 connected to the sensor connector 20 can be loosely curved and can be bundled near the throttle body 12. Accordingly, when the throttle apparatus 10 of the present embodiment is employed, it is possible to compactly mount the throttle apparatus 10 on the general engine 1.

Further, in the throttle apparatus 10 of the present embodiment, the length in the axial direction of the connector arrangement projection part 35 is shorter than the length in the axial direction of the motor housing part 12*b* of the throttle body 12, and the connector arrangement projection part 35 is arranged to be deviated to the one end side in the axial direction of the throttle body 12. Therefore, the motor connector 36 provided on the connector arrangement projection part 35 is arranged at a position that is lower by one step from another end in the axial direction of the throttle body 12. Accordingly, when the configuration of the present embodiment is employed, the electric cable 37 connected to the motor connector 36 can be loosely curved and can be bundled at a position further close to the throttle body 12 and the electric cable 21 for the sensor. Accordingly, the throttle apparatus 10 can be further advantageously mounted compactly on the general engine 1.

The present invention is not limited to the embodiment described above, and various design changes can be made without departing from the scope thereof. For example, the general engine 1 of the embodiment described above is a V-type dual cylinder engine; however, the arrangement shape and the number of cylinders are not limited thereto and are arbitrary. Further, the protrusion direction of the crankshaft 2 is also not limited to the horizontal direction and may be a vertical direction.

DESCRIPTION OF THE REFERENCE SYMBOLS

1 General engine
10 Throttle apparatus
11 Intake air introduction hole
12 Throttle body
12*b* Motor housing part
13 Throttle valve
14 Throttle shaft
15 Electrically driven motor
17 Output shaft (motor shaft)
19 Sensor block
20 Sensor connector
21 Electric cable
23 Drive gear
24 Driven gear
25 Middle gear
25*a* Support shaft (gear shaft)
34 Gear arrangement projection part
35 Connector arrangement projection part
36 Motor connector
37 Electric cable
V Imaginary straight line

The invention claimed is:

1. A general engine throttle apparatus that is a throttle apparatus of a general engine, comprising:

a throttle body that has an intake air introduction hole and a motor housing part;

a throttle valve that opens and closes the intake air introduction hole;

a throttle shaft that holds the throttle valve and that is rotatably supported by the throttle body;

an electrically driven motor that is arranged on the motor housing part such that a motor shaft becomes substantially parallel with the throttle shaft and that gives a rotation operation force to the throttle shaft;

a drive gear that is provided integrally with the motor shaft;

a driven gear that is provided integrally with the throttle shaft;

a middle gear that is held on one end of the throttle body such that a gear shaft becomes substantially parallel with the motor shaft and the throttle shaft and that is engaged with the drive gear and the driven gear; and a sensor block that is attached to a position facing an end part of the throttle shaft on another end of the throttle body and that includes a sensor which detects a state in a vicinity of the throttle valve, wherein a motor connector for connecting an electric cable to the electrically driven motor is provided in a vicinity of the motor housing part on an outer surface of the throttle body, and a sensor connector for connecting an electric cable to the sensor is provided on an outer surface of the sensor block, wherein the middle gear is held by the throttle body such that the gear shaft is displaced from an imaginary straight line connecting together the motor shaft and the throttle shaft, a gear arrangement projection part that projects outward by a displacement amount of the middle gear and a connector arrangement projection part that projects to a same side as the gear arrangement projection part at a position adjacent to a motor housing part side of the gear arrangement projection part are formed on an outer surface of the throttle body, the motor connector is arranged on the connector arrangement projection part such that the motor connector is in parallel with an axis center of the motor shaft and faces another end side of the throttle body, and the sensor connector is arranged on the sensor block such that the sensor connector is directed toward the axis center from a direction that is orthogonal to the axis center of the motor shaft.

2. The general engine throttle apparatus according to claim 1, wherein a length of the connector arrangement projection part in a direction along the motor shaft is shorter than a length in an axial direction of the motor housing part of the throttle body, and the connector arrangement projection part is arranged to be deviated to the one end side of the throttle body.

* * * * *